United States Patent [19]

Hemmer et al.

[11] 4,381,135

[45] Apr. 26, 1983

[54] SOCKET TYPE CONTACT ASSEMBLY

[75] Inventors: Valentine J. Hemmer; R. Amelia Piscitelli, both of Sidney, N.Y.

[73] Assignee: The Bendix Corporation, Southfield, Mich.

[21] Appl. No.: 228,493

[22] Filed: Jan. 26, 1981

[51] Int. Cl.[3] ..... H01R 4/10

[52] U.S. Cl. ..... 339/258 R; 339/262 R; 339/276 T; 29/876

[58] Field of Search ..... 339/276 R, 276 T, 258 R, 339/258 P, 262, 259 R, 223 R; 29/753, 876, 882; 174/84 C

[56] References Cited

U.S. PATENT DOCUMENTS

| | | | |
|---|---|---|---|
| 2,346,831 | 4/1944 | Drury | 339/259 R |
| 3,550,068 | 12/1970 | Castellani | 339/276 T |
| 3,758,703 | 9/1973 | Golden et al. | 174/84 C |
| 4,072,394 | 2/1978 | Waldron et al. | 339/276 T |
| 4,120,556 | 10/1978 | Waldron et al. | 339/276 T |
| 4,136,923 | 1/1979 | Spaulding | 339/258 R |

*Primary Examiner*—John McQuade
*Assistant Examiner*—Gary F. Paumen
*Attorney, Agent, or Firm*—Raymond J. Eifler

[57] ABSTRACT

This invention relates to electrical connectors and more particularly to a three-piece socket type electrical contact for the connector. The socket type contact includes an inner sleeve (10) stamped and formed from a single sheet of beryllium copper metal, the sleeve having a rear wire receiving portion that includes a groove (11) having a plurality of elongated slots located in said groove; a copper ferrule (20) located in said groove; and a stainless steel rear sleeve (40) telescopically mounted over the rear portion of the inner sleeve (10) and said ferrule (20).

4 Claims, 3 Drawing Figures 11
20
10
12
14
14

35
40
12
36
30
10
20
37
14

35
50
12
36
30
10
20
50
14

SOCKET TYPE CONTACT ASSEMBLY

This invention relates to electrical connectors and more particularly to a socket type electrical contact assembly for the connector.

Electrical connectors generally comprise a shell or housing; a plurality of electrical contacts, each of which are connected to separate incoming wires; and a dielectric insert assembly or fixedly or removably mounting the electrical contacts in the connector shell. In an attempt to reduce the size and cost of electrical connectors, the contacts which formerly were machined from a single piece are being replaced with less expensive electrical contacts stamped and formed from a sheet of metal and protected by one or more sleeves. Examples of such stamped and formed contacts may be found in U.S. Pat. Nos. 4,072,394 entitled "Electrical Contact Assembly" issued Feb. 7, 1978; 4,120,556 entitled "Electrical Contact Assembly" issued Oct. 17, 1978; and 4,136,923 entitled "Unitary Hooded Electrical Contact" issued Jan. 30, 1979. Presently, three piece contacts are made by stamping an inner sleeve from a sheet of metal; e.g., beryllium copper forming it into a desired shape, heat treating it to obtain a desired resiliency, and then placing additional sleeves comprised of stainless steel over the front and rear portions of the inner sleeve for strength and protection. In a three piece contact of the type shown in the U.S. Pat. No. 4,072,394, the rear section of the inner sleeve has a plurality of elongated slots arranged in the wire receiving end of the inner sleeve to allow the inner sleeve to distort symetrically when a wire is inserted into and crimped to the contact assembly. The slots also provide a mechanical bond to prevent a wire crimped to the sleeve from moving axially. However, during the crimping of a wire to the contact, the outer stainless steel sleeve cracks or tears often because it is pressed into the slots of the inner sleeve. This causes an objectionable appearance and makes the contact susceptible to further fracture.

DISCLOSURE OF THE INVENTION

This invention is a four piece socket type contact that eliminates the problem of fracturing of the outer stainless steel sleeve when a wire is crimped to the contact.

The invention is a four piece contact of the type having a beryllium copper inner sleeve and a rear stainless steel sleeve telescopically mounted around the inner sleeve and is characterized by a copper ferrule located in a groove in the rear wire receiving portion of the inner sleeve with elongated slots located in the groove.

Accordingly, an advantage of this invention is to provide a four piece contact having an outer sleeve that does not fracture when crimped.

Another advantage of the invention is that it improves the appearance of the contact after crimping by eliminating fractures of the outer sleeve.

A further advance is that the ferrule lowers the resistance drop between the contact and a wire crimped to the contact.

DETAILED DESCRIPTION OF THE INVENTION

Figure 1:
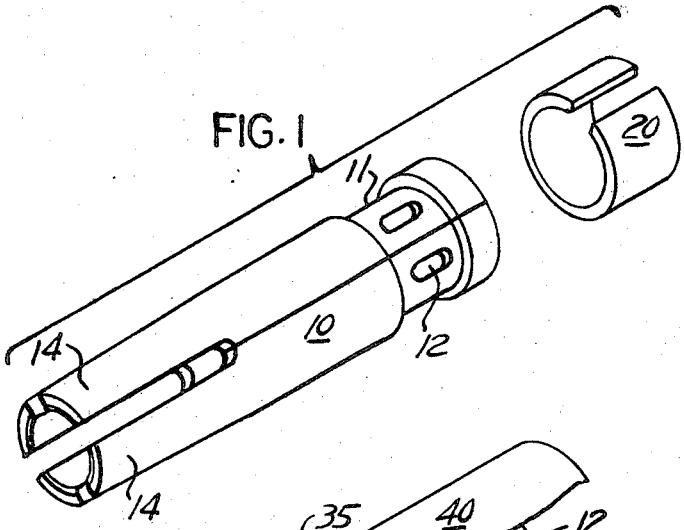
FIG. 1 illustrates the inner sleeve of a four piece contact and the ferrule that is mounted to the sleeve.

Referring now to the drawings, FIG. 1 illustrates the inner sleeve 10 of a four piece contact having a copper ferrule 20 that is to be mounted to the sleeve 10. The inner sleeve 10 is comprised of beryllium copper and includes a plurality of resiliently and radially deflectable fingers 14 at the mating end and a groove 11 at the wire receiving end which includes a plurality of elongated slots 12 located in a groove 11. The ferrule 20 is mounted in the groove 11 by expanding its opening, placing it onto the sleeve and then closing the ferrule around the groove 11 in the sleeve 10. The addition of the ferrule 20 provides additional contact with an incoming wire crimped to the sleeve 10 thereby reducing the resistance drop between the contact and a wire crimped to the contact.

Figure 2:
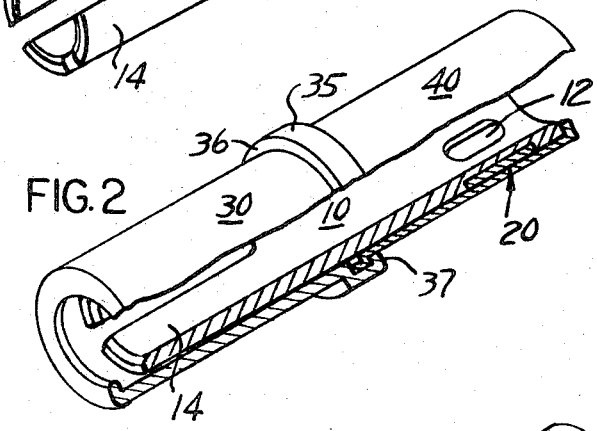
FIG. 2 illustrates a four piece contact assembly embodying the principles of this invention.

FIG. 2 illustrates a four piece contact assembly of the type having an inner sleeve 10, a forward sleeve 30 around radially deflectable fingers 14; a rear sleeve 40 mounted around the wire receiving end of the inner sleeve 10 having the slots 12 therein; and a ferrule 20 mounted in the groove 11 in the inner sleeve 10. In this embodiment, the forward sleeve 30 includes an enlarged portion 35 that includes a forwardly facing shoulder 36 and a rearwardly facing shoulder 37 which is adapted to engage a contact retention mechanism in an electrical connector insert.

Figure 3:
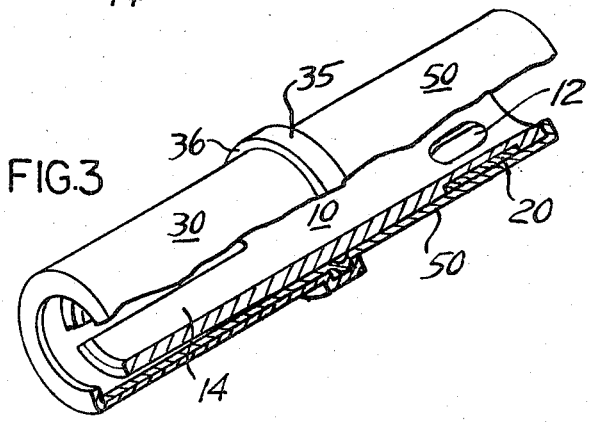
FIG. 3 illustrates an alternate embodiment of a four piece contact embodying the principles of this invention.

FIG. 3 illustrates an alternate embodiment of the four piece contact where in the contact is comprised of an inner sleeve 10, an intermediate sleeve 50 telescopically mounted to inner sleeve 10, and a forward sleeve 30 mounted around the forward mating portion of the inner sleeve 10 to protect the deflectable fingers 14.

While a preferred embodiment of the invention has been disclosed, it will be apparent to those skilled in the art that changes may be made to the invention as set forth in appendant claims and, in some instances certain features of the invention may be used to advantage without corresponding use of other features. Accordingly, it is intended that the illustrative and descriptive materials herein be used to illustrate the principles of the invention and not to limit the scope thereof.

Having described the invention, what is claimed is:

1. In combination with a contact of the type having: a one-piece inner sleeve having a forward mating portion, a rear wire receiving portion having a plurality of elongated slots therein and a middle portion; a rear sleeve telescopically mounted to the rear portion of the inner sleeve; and a forward sleeve telescopically mounted to the forward portion of said inner sleeve, the improvement comprising:

a groove in the rear wire receiving portion of said inner sleeve with said elongated slots located in said groove; and a ferrule located in said groove.

2. The contact as recited in claim 1 wherein said rear sleeve is comprised of stainless steel, said ferrule is comprised of copper and said inner sleeve is comprised of beryllium copper.

3. A method of making a contact comprising the steps of:

stamping from a single piece of metal a generally rectangular member having a plurality of fingers extending from one end, a groove in the opposite end portion, and a plurality of elongated slots located in said groove and having their longitudinal axis aligned with the longitudinal axis of said rectangular member;

forming said piece of metal into a tubular member with said fingers extending from one end, a wire receiving portion extending from the opposite end;

heating said tubular member to obtain a desired resiliency of said fingers;

mounting a copper sleeve in said groove;

telescopically mounting a sleeve to said wire receiving portion; and telescopically mounting a sleeve around said fingers.

4. In combination with an electrical socket type contact assembly of the type having: an inner sleeve stamped and formed from a single sheet of metal, said sleeve having a front mating portion, a rear wire receiving portion having a plurality of longitudinally extending slots, and a plurality of axially extending fingers in the front mating portion of the sleeve, said fingers resiliently deflectable in a radial direction; an intermediate sleeve telescopically mounted over said inner sleeve; and an outer sleeve telescopically mounted on the front portion of said intermediate sleeve, said outer sleeve having an enlarged portion that includes a forwardly facing shoulder, the improvement comprising:

a groove in the rear wire receiving portion of said inner sleeve with said elongated slots located in said groove; and a ferrule located in said groove.

* * * * *